US006116568A

United States Patent [19]

Rosenblat et al.

[11] Patent Number: 6,116,568

[45] **Date of Patent: *Sep. 12, 2000**

[54] APPARATUS FOR FORMING VOIDS UNDER CONCRETE FLOORS

[75] Inventors: Michael L. Rosenblat, Winnipeg; Timothy J. Isles, Leamington; Louis C. Dufault, Winnipeg, all of Canada

[73] Assignee: Void Form International Ltd., Canada

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,302

[22] Filed: Apr. 30, 1998

Related U.S. Application Data

[60] Provisional application No. 60/071,974, Jan. 20, 1998.

[51] Int. Cl.[7] ..... B28B 7/28; B28B 7/34

[52] U.S. Cl. ..... 249/184; 249/DIG. 2; 249/61; 249/185; 52/792.1; 52/795.1; 493/964; 493/966; 493/390; 229/120.17; 229/120.36; 229/120.25

[58] Field of Search ..... 52/792.1, 795.1; 493/964, 965, 966, 968, 391, 390, 92, 91, 90; 229/120.17, 120.36, 120.24, 120.25; 249/DIG. 2, 61, 175, 184, 185, 186, 207

[56] References Cited

U.S. PATENT DOCUMENTS

| | | | |
|---|---|---|---|
| 1,892,311 | 12/1932 | MacDonald | 249/175 |
| 2,718,997 | 9/1955 | Shuxteau | 229/120.17 |
| 2,881,501 | 4/1959 | Raney | 249/175 |
| 3,024,513 | 3/1962 | Shuxteau et al. | 249/134 |
| 3,109,217 | 11/1963 | Kell | 249/176 |
| 3,358,960 | 12/1967 | Oliver et al. | 249/175 |
| 3,512,747 | 5/1970 | Stark | 249/134 |
| 3,549,116 | 12/1970 | Ferry et al. | 249/184 |
| 3,857,217 | 12/1974 | Reps | 52/592.1 |
| 4,685,267 | 8/1987 | Workman | 52/577 |
| 4,827,690 | 5/1989 | Viger | 52/782.1 |
| 5,273,206 | 12/1993 | Vassiliou | 229/117.01 |
| 5,476,216 | 12/1995 | Robertella et al. | 229/117.01 |
| 5,506,046 | 4/1996 | Andersen et al. | 428/34.5 |

OTHER PUBLICATIONS

Unknown Author, Introducing Void Form International (Brochure), pp. 13–31, Unknown Date.

Gates Sure–Void, Advertisement of Gates & Sons, Inc., Prior to May 29, 1996.

*Primary Examiner*—Harold Pyon
*Assistant Examiner*—Joseph S. Del Sole
*Attorney, Agent, or Firm*—Piper Marbury Rudnick & Wolfe

[57] ABSTRACT

A reinforced box-like structure for forming a void area in a concrete formation. The structure includes a bottom panel having a plurality of spaced apart, parallel base partitions and a top panel having a plurality of spaced apart, parallel top partitions. The base partitions extend across the bottom panel and in a direction normal to the bottom panel, and the top partitions extend across the top panel and in a direction normal to the top panel. Each of the base partitions and top partitions include a plurality of double-thickness walls with a plurality of slots therein and flat top edges between the slots. The structure is assembled by superimposing the top panel over the bottom panel such that the base partitions extend transversely relative to the top partitions. Thus, the slots in the base partitions register in interlocking relationship with the corresponding slots in the top partitions, wherein the base partitions extend substantially to the top panel and the top partitions extend substantially to the bottom panel to create a cellular box-like structure that generally fills a space between the bottom panel and top panel with the flat top edges engaging the respective top or bottom partition.

10 Claims, 4 Drawing Sheets

APPARATUS FOR FORMING VOIDS UNDER CONCRETE FLOORS

This application claims the benefit of U.S. Provisional Appl. No. 60/071,974 filed Jan. 20, 1998.

FIELD OF INVENTION

The present invention relates generally to reinforced cardboard structures for creating voids in concrete formations, and more particularly, to a box-like structure capable of being assembled at a construction site or customer's location and supporting a structural floor or foundation until the concrete dries and the box-like structure deteriorates, thereby creating a void in the concrete formation.

BACKGROUND OF THE INVENTION

It is commonly known in the construction industry to create spaces or voids in or under various types of concrete formations. For example, concrete formations below grade such as the structural foundation of a building often require a space or void between the foundation and the ground to accommodate expansion of the soil, thereby preventing damage to the foundation. Thus, it is often desirable to create a void between the structural floor and/or grade beams of a foundation and the underlying soil to accommodate upheaval of the soil. It may also be desirable to create a void between the walls of a foundation and the surrounding soil to accommodate a similar expansion of the soil below grade. In addition, voids can also be utilized above grade between concrete floor slabs to reduce the amount of concrete required and to make the resulting slab lighter.

Another type of concrete formation that sometimes requires a void is a concrete pillar or column. It is often desirable to create a void in a pillar or column to allow room for internal plumbing, electrical conduits or the like within the column. By forming a void in the column, the items within the column are protected and the cost of making the column can be reduced because less concrete is required.

Typically, these voids are created by placing a biodegradable support structure made of corrugated cardboard in the desired location. These support structures are configured to support the building structural components until the poured concrete is capable of holding its own weight. As the concrete dries, and as the cardboard eventually deteriorates, a void is left in the concrete formation. However, such support structures are typically difficult to assemble and often can only be assembled at a factory and transported to a construction site.

It is known to provide a plurality of paperboard panels for assembling at a construction site to form a support structure having an internal reinforcing cell structure. While support structures that may be assembled at the construction site have been known, the prior art structure provides an unsatisfactory compressive strength. Of the many features which in combination provide the overall compressive strength, the prior art provides triangular shaped peaks which serve as interior supports for the support structure side walls. Such triangular peaks offer low compressive strength and thus adversely effect the quantity of concrete that may be supported by the support structures.

Therefore, it remains desirable to provide an inherently strong support structure having excellent compressive strength and that can be either delivered factory assembled to the construction site, or delivered in a "knocked-down" configuration for easy assembly and installation on site.

SUMMARY OF THE INVENTION

In view of the above, and in accordance with the present invention, there is provided a reinforced box-like structure for forming a void area in a concrete formation. The box structure includes a bottom panel having a plurality of spaced apart, parallel base partitions and a top panel having a plurality of spaced apart, parallel top partitions. The base partitions extend across the bottom panel and in a direction normal to the bottom panel, and the top partitions extend across the top panel and in a direction normal to the top panel. Each of the base partitions and top partitions has a plurality of slots therein. The box structure is assembled by superimposing the top panel over the bottom panel such that the base partitions extend transversely relative to the top partitions. Thus, the slots in the base partitions register in interlocking relationship with the corresponding slots in the top partitions, wherein the base partitions extend substantially to the top panel and the top partitions extend substantially to the bottom panel to create a cellular box-like structure that generally fills a space between the bottom panel and top panel.

In one form of the structure, the bottom panel and top panel are configured as corrugated paperboard blanks prior to assembly. The bottom panel is then folded along crease lines thereon to form base partitions having a double thickness wall. Similarly, the top panel is folded along crease lines thereon to form said top partitions having a double thickness wall. Thus, the double-thickness walls of the base and top partitions increase the vertical strength of the box structure to provide adequate support for the concrete formation.

Preferably, the top panel has opposing end flaps extending parallel to the top partitions and the bottom panel has opposing end flaps extending parallel to the base partitions. The end flaps of the top panel have a locking section with a plurality of slots therein, and each base partition of the bottom panel has a recess formed in opposing end portions thereof for registering with the respective slots in the end flap locking sections. Likewise, the end flaps of the bottom panel have a locking section with a plurality of slots therein, and each top partition of the top panel has a recess formed in opposing end portions thereof for registering with the respective slots in the end flap locking sections. Thus, the box structure is closed by tucking the top panel end flaps into engagement with the base partitions such that the slots in the top panel locking sections register with the respective recesses in the base partitions. The bottom panel end flaps are also tucked into engagement with the top partitions such that the slots in the bottom panel locking sections register with the respective recesses in the top partitions. Also preferably, an aperture is formed in each end panel to define a handle for transporting the box structure.

In the preferred embodiment, a slit score is provided on one side of the corrugated paperboard. When folded away from the slit score, the paperboard forms a double-thickness wall with a flat top edge.

During assembly of the structure, the inherent strength of the corrugated paper resists inadvertent folding at undesirable locations, thereby facilitating a unique folding action that allows quick and easy assembly of the box structure, which is typically in the form of a beam or floor structure. The box structures can be delivered factory assembled to the construction site, or they can be delivered in a "knocked-down" configuration to allow for stacking, thereby saving on space and costs for transport. Once at the site, the box structures can be easily assembled and installed. The interconnections of the box structure also eliminate the need for mechanical fasteners.

The present invention, together with further objects and advantages, will be best understood by reference to the following detailed description taken in conjunction with the accompanying drawings.

DETAILED DESCRIPTION OF THE PREFERRED EMBODIMENT

Figure 1:
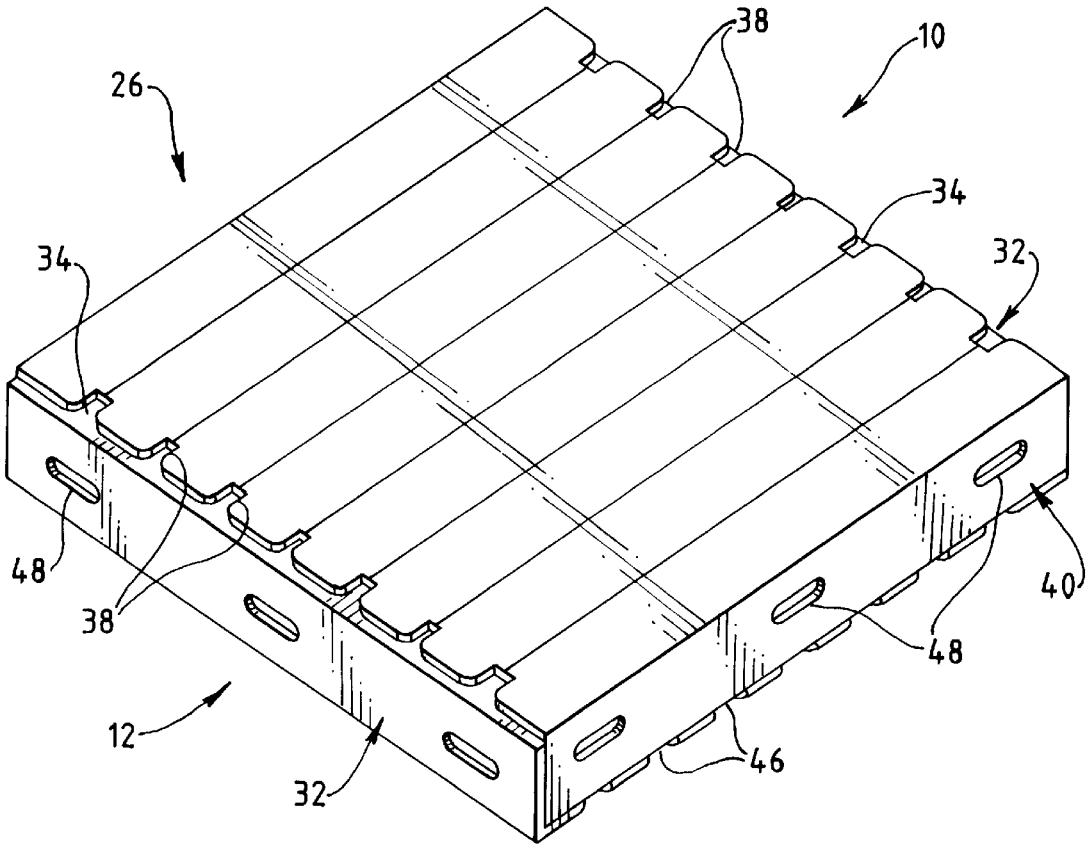
FIG. 1 is a perspective view of a box-like structure of the present invention shown fully assembled.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated. Referring now to the drawings, wherein like reference numerals refer to like parts throughout the several views, there is shown in FIG. 1 a reinforced box-like structure 10 for forming a void area in a concrete formation (not shown). Although only a single box-like structure 10 is shown in FIG. 1, it will be understood by those having ordinary skill in the art that in a typical construction site, a plurality of box-like structures substantially identical to the structure 10 would be placed underneath the foundation of a building to support substantially the entire concrete structure.

Figure 2:
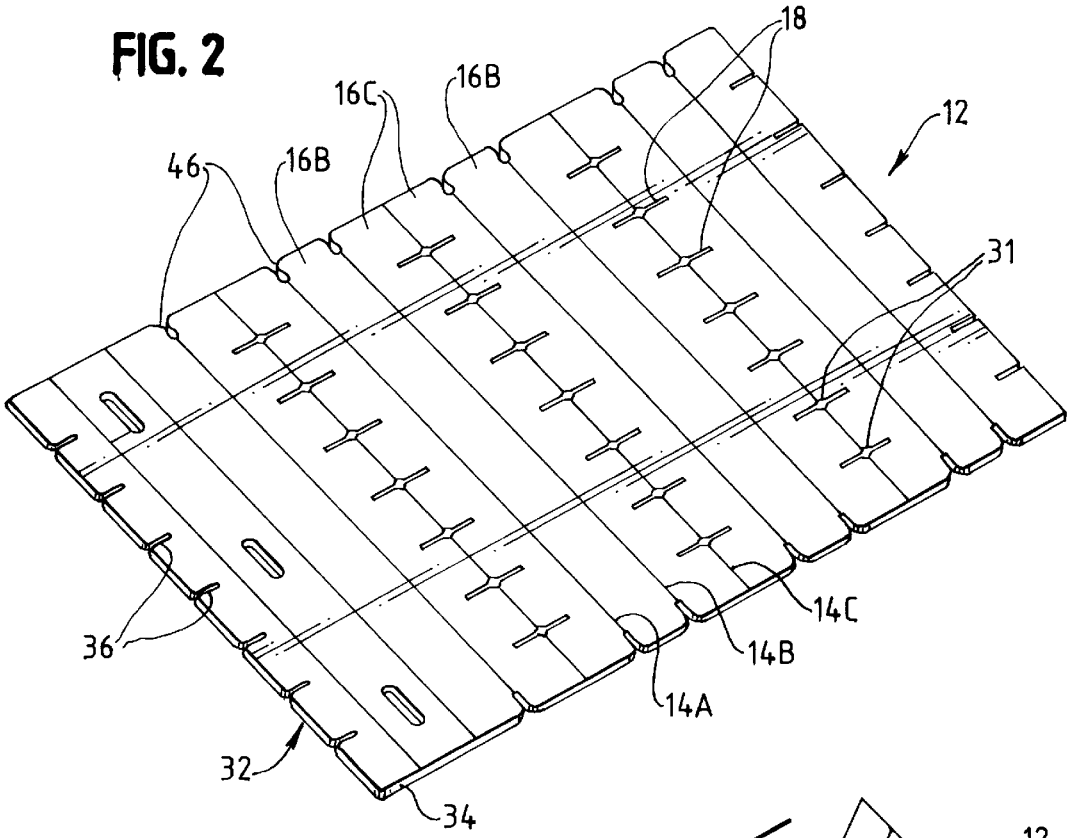
FIG. 2 is a perspective view of one bottom panel in blank form prior to being assembled into the box-like structure of the present invention.
Figure 3:
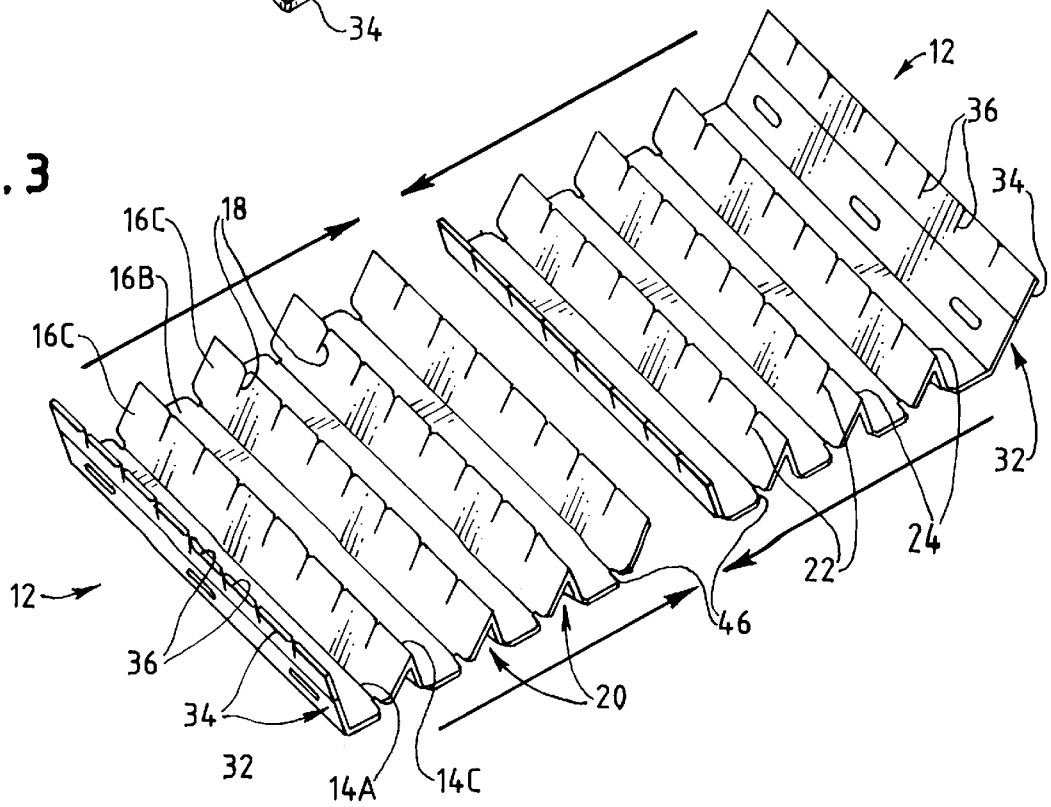
FIG. 3 is a perspective view showing two bottom panels being folded along crease lines to create a plurality of base partitions in accordance with the present invention.

Referring now to FIGS. 2 and 3, the structure 10 is formed by folding a pair of identical, rectangular bottom panels 12 of corrugated paperboard initially provided in the form of blanks or planar sheets. FIG. 2 illustrates one of the bottom panels 12 in blank form prior to folding. The bottom panels 12 have several sets of parallel lines 14A-C thereon defining panel sections 16B and 16C to allow folding as shown in FIG. 3. Preferably, a plurality of equally spaced slits 18 extend transversely and generally perpendicularly across every third line 14C (FIG. 2). The lines 14A, B are crease lines, whereas the lines 14C are slit scores formed on the one side (the top side as seen in FIG. 2) of the panel 12.

Figure 4:
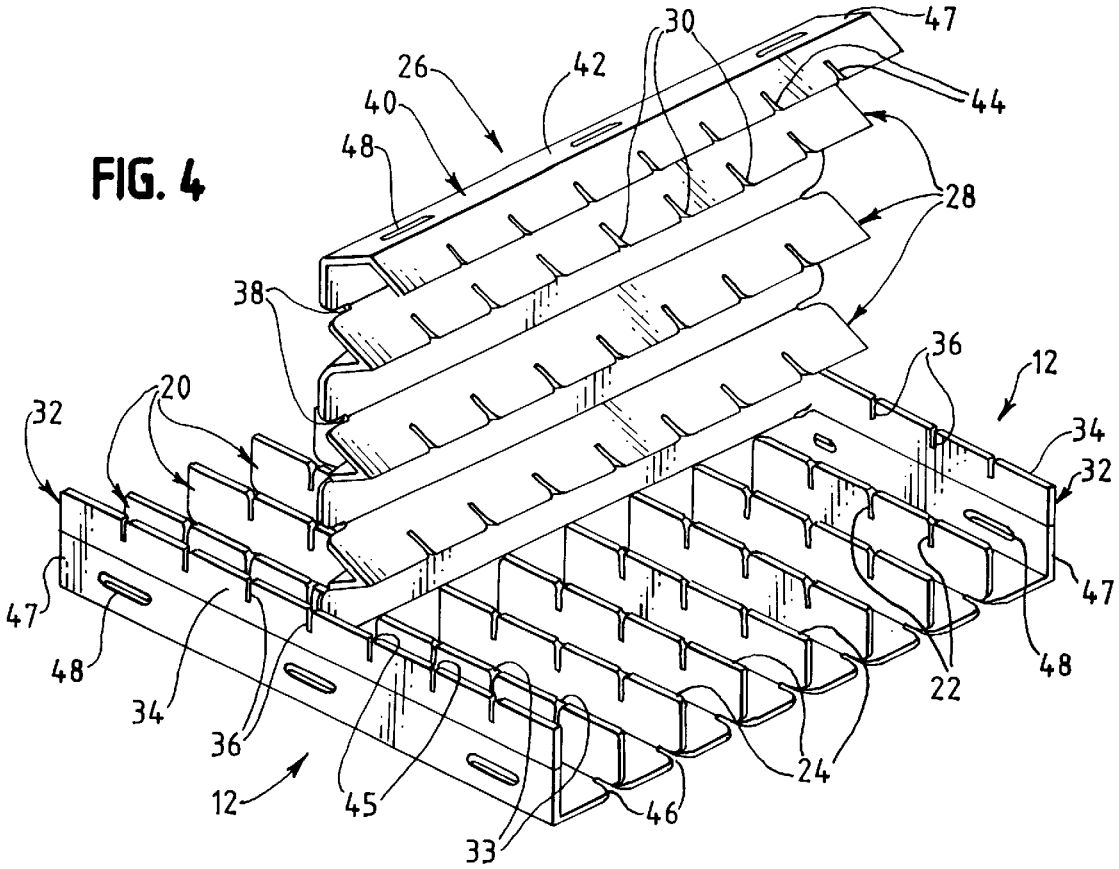
FIG. 4 is a perspective view showing one top panel being superimposed over the bottom panels such that the base partitions of the bottom panels extend transversely relative to top partitions of the top panel, and the slots in the base partitions register with the slots in the top partitions.
Figure 7:
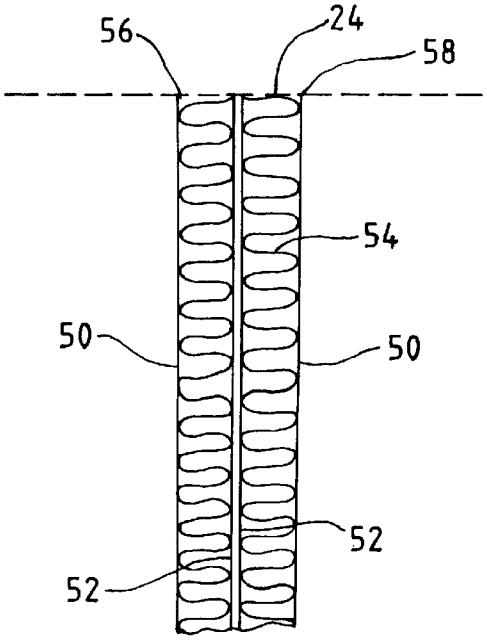
FIG. 7 is a cross sectional view of a base partition, and is similar to the cross sectional view of a top partition.

To assemble the structure 10, the bottom panels 12 are folded so that the panel sections 16C on each side of the third lines (slit score) 14C are moved inwardly toward each other to define a plurality of double-thickness walls (FIGS. 3 and 4). As the walls are formed by folding the panel sections 16C away from the slit scores so that the slit scores are at the peak of the walls, the double-thickness walls form flat top edges 24 (FIG. 7). The panels 16C thus form a plurality of spaced apart base partitions 20 extending across the bottom panels 12 and in a direction normal to the bottom panels 12 (FIG. 4).

As shown in FIGS. 2 and 3, the panels 16C are configured so that the slits 18 on each third line (slit score) 14C are folded generally in half to form a plurality of unitary insertion slots 22. The insertion slots 22 preferably extend approximately one half the distance from flat top edges 24 of the base partitions 20 to the bottom panel 12.

Figure 5:
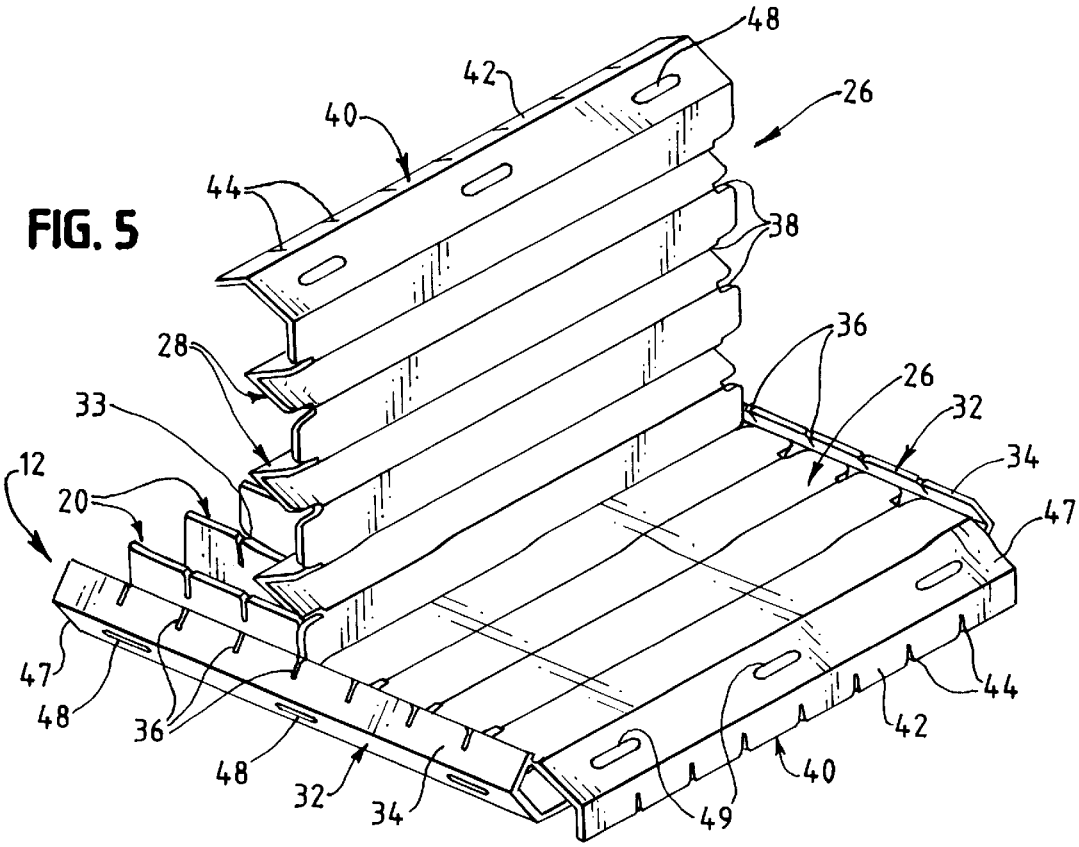
FIG. 5 is a perspective view showing a second top panel being superimposed over the bottom panels such that the base partitions of the bottom panels extend transversely relative to top partitions of the second top panel.
Figure 6:
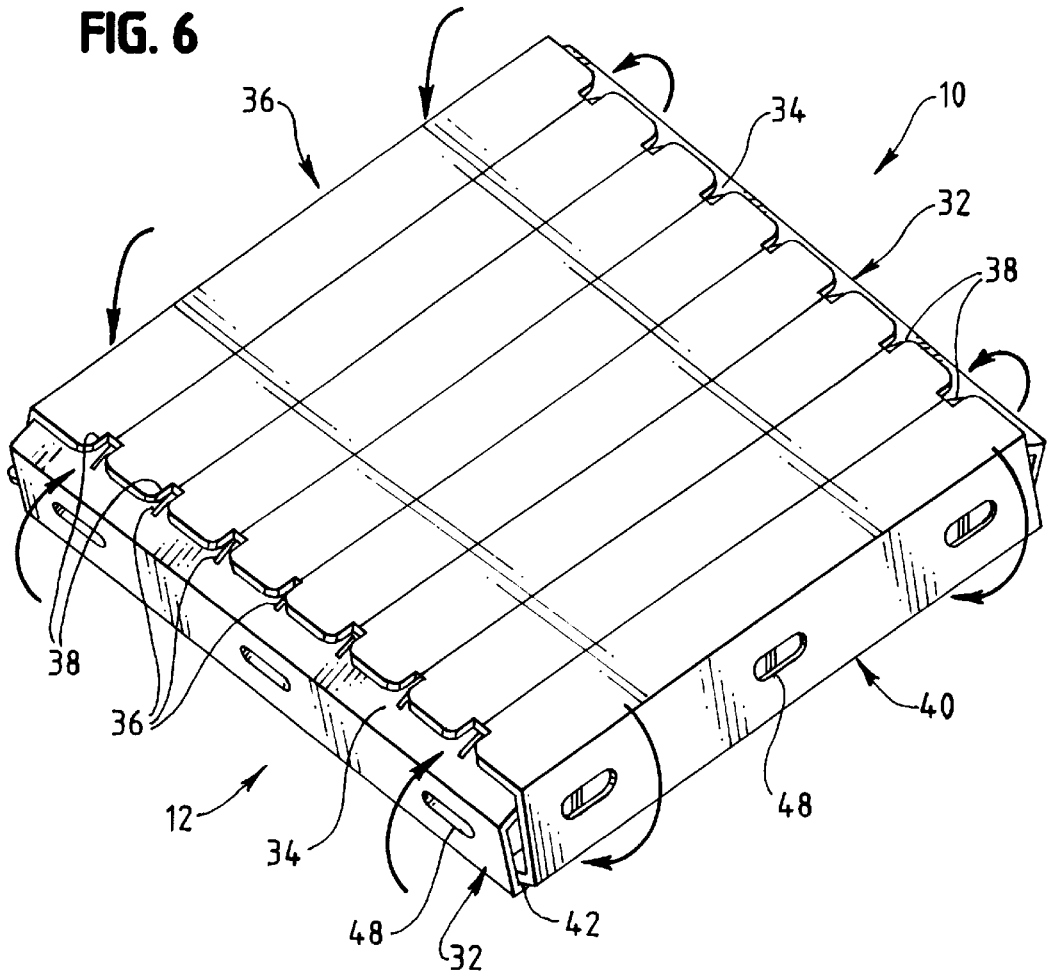
FIG. 6 is a perspective view showing opposing end flaps of the top panel being tucked into a closed position and opposing end flaps of the bottom panel being tucked into a closed position.

A pair of rectangular top panels 26 identical to the bottom panels 12 are folded in substantially the same manner described above. Before assembling the top panels 26 to the bottom panels 12 as shown in FIGS. 4 and 5, the bottom panels 12 are placed in end-to-end relation next to each other as shown in FIG. 3. The top panels 26 are then positioned over the bottom panels 12 such that top partitions 28 extend transversely relative to the base partitions 20. The structure is assembled by superimposing the top panels 26 over the bottom panels 12 so that insertion slots 30 in the top partitions 28 register in interlocking relationship with the corresponding insertion slots 22 in the bottom partitions 20. As a result, the flat top edges of the base partitions 20 extend substantially to the top panels 26 and the flat top edges of the top partitions 28 extend substantially to the bottom panels 12. This provides an inherently strong, cellular box-like structure that can support a great deal of weight when concrete is poured thereon to create a void.

As will be appreciated, the slots 22 and 30 have a thickness substantially the same as the overall thickness of the partitions 20 and 28 to allow the slots 22 and 30 to register with such partitions 20 and 28. To facilitate insertion of the partitions 20 and 28 in the slots 22 and 30, the slits 18 have a recess 31 formed in a middle portion thereof (FIG. 2), wherein the folding of the slits 18 in half creates a chamfer region 33 on the top of each slot 22 and 30 to guide the associated partitions 20 or 28 therein (FIGS. 4 and 5).

As best shown in FIG. 5, the bottom panels 12 are assembled together such that opposing end flaps 32 are capable of being folded or tucked into locking engagement with the top partitions 28. To accomplish this task, the end flaps 32 have a locking section 34 with a plurality of side slots 36 formed therein for engagement with corresponding recesses 38 formed in the top partitions 28. Preferably, the recesses 38 are formed in opposing end portions of each top partition 28 for registering with the respective slots 36 in the locking sections 34 of the bottom panel end flaps 32. Likewise, the top panels 26 are assembled together such that opposing end flaps 40 are capable of being folded or tucked into locking engagement with the base partitions 20. The top panel end flaps 40 also have a locking section 42 with a plurality of slots 44 formed therein for registration with corresponding recesses 46 in the base partitions 20. Thus, once the top panels 26 have been superimposed over the bottom panels 12, the opposing end flaps 32 of the bottom panels 12 and the opposing end flaps 40 of the top panels 26 are tucked into their respective closed positions as shown in FIG. 1 to create a completely closed structure. This inhibits concrete poured thereabout from entering the structure, so that when the box disintegrates, a void is left between the ground and the concrete structure. To facilitate insertion of the end flaps 32 and 40 into engagement with the partitions

20, the slots 36 and 44 have a chamfer region 45 to guide the partitions 20 therein. Moreover, each of the end flaps 32 and 40 have a handle section 47 configured with apertures 48 which act as handles for transporting the assembled structure 10 to the desired location at a construction site.

In one embodiment of the invention illustrated in FIG. 7 the top panels 26 and bottom panels 12 are made of corrugated paperboard having a first side 50 and a second side 52 with flutes 54 between the first and second sides 50, 52. The slit scores 14C extend through only the first side 50. The first side 50 with the slit score forms two edges 56, 58 on either side of the slit score 14C. The flat top edges 24 are formed by the two edges 56, 58 and the exposed flute 54 therebetween.

Preferably, the box structure 10 is manufactured to ISO 9001 Standards and is available in a wide variety of sizes, shapes and strengths to accommodate the desired void-forming application. For example, the box structure is preferably available in a Standard strength having approximately 1000 PSF ultimate capacity, which is approved for concrete floors up to a maximum of 12 inches thick; an Extra strength having approximately 1500 PSF ultimate capacity, which is approved for concrete floors up to a maximum of 18 inches thick; and a Super strength having approximately 2000 PSF ultimate capacity, which is approved for concrete floors up to a maximum of 24 inches thick. It should be noted that an engineer's discretion may be substituted for the maximum thicknesses stated for each strength. The dimensions of the box structure itself can also vary depending on the particular application. For example, the standard, extra and super strength versions of the box structure 10 preferably have the following optional dimensions: 48×48×4, 6, or 8 inches for a total of 16 square feet per unit; 36×36×10 inches for a total of 9 square feet per unit; and 30×30×12 inches for a total of 6.25 square feet per unit.

In a preferred form of the invention, the box structure 10 is covered with a protective coating on each exterior surface to provide temporary protection prior to installation of the box structure 10 at the construction site. In a preferred embodiment, the coating is wax. In case of extremely wet ground conditions, it may be desirable to cover the box structure 10 with a water resistant membrane. For example, the box structure 10 can be covered with a polyurethane coating, preferably about 4 millimeters thick, with overlapping joints where required. Where fitting is required, a desired area can be wrapped to prevent penetration of water from wet concrete.

Thus, a box-like structure is provided which is inherently strong and easy to assemble without glues or mechanical fasteners at a construction site or prior to delivery to the construction site. The strength of the corrugated paper and the orientation of the crease lines facilitates the unique folding action to allow quick and easy assembly of the partitions, and the double-thickness walls of the partitions with flat peaks increase the strength of the box structure to provide adequate support for a concrete formation.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A pair of reinforced cardboard panels for forming a reinforced box shaped structure for creating a void area in a concrete formation, each panel comprising:

a series of two adjacent wall panel sections, the two adjacent wall panel sections divided by a slit score with a transverse slit extending across the slit score; and a horizontal panel section adjacent each of the two adjacent wall panel sections, each of the horizontal panel sections and respective adjacent wall panel sections divided by a crease line;

said two adjacent wall panel sections of each reinforced cardboard panel defining a double-thickness wall with a flat top edge when folded about the slit score and the transverse slit of each reinforced cardboard panel sized to receive the double-thickness wall of the other reinforced cardboard panel so that each of the flat top edges is parallel to and supports the horizontal panel sections of the other reinforced cardboard panel when the pair of reinforced cardboard panels are interlocked via the transverse slits so that the horizontal panel sections of each reinforced cardboard panel define surfaces that may support poured concrete due to the support provided by the parallel flat top edges.

2. The reinforced cardboard panels of claim 1 wherein each panel is made of corrugated paperboard having a first side and a second side with the slit score between the two adjacent wall panel sections extending only through the first side.

3. The reinforced cardboard panels of claim 1, each part further comprising a plurality of slits extending transversely across each slit score, a recess at the intersection of each slit and the respective slit score, and a recess at the ends of each crease line.

4. The reinforced cardboard panels of claim 3, each panel further comprising a single wall panel section adjacent a horizontal panel section and forming one end panel;

a locking panel section forming an opposite end of the panel, the locking panel section having side slots; and an end flap, located inward from and adjacent to the locking panel section whereby four of the panels are assembled to form a reinforced box shaped structure having a top and bottom formed by the horizontal panel sections, sides formed by the end flaps, and an internal cell structure formed by the wall panel sections and the flat top edges of the wall panel sections adjacent respective horizontal panel sections.

5. The reinforced cardboard panel of claim 4, wherein the end flaps include at least one handle aperture.

6. A reinforced box shaped structure for forming a void area in a concrete formation, comprising:

a cell structure formed by a first row of parallel extending two adjacent wall panel sections, and a second row of parallel extending two adjacent wall panel sections intermeshed with and perpendicular to the first row, each of the two adjacent wall panel sections forming a flat top edge having a score;

a bottom side formed by a plurality of horizontal panel sections, each horizontal panel section having edges connected to and between respective pairs of the two adjacent wall panel sections of the first row, opposite from the flat edge, the bottom side parallel to and adjacent the flat edges of the second row so that said bottom side defines a surface that is adapted to support a portion of the concrete formation due to the support provided by the parallel flat top edges of the second row;

a top side formed by a plurality of horizontal panel sections, each horizontal panel section having edges connected to and between respective pairs of the two adjacent wall panel sections of the second row, opposite from the flat edge, the top side parallel to and adjacent the flat edges of the first row so that said top side defines a surface that is adapted to support a portion of the concrete formation due to the support provided by the parallel flat top edges of the first row; and end flaps forming the four sides of the structure, each of the end flaps extending from one of the horizontal panel sections.

7. The reinforced box-shaped structure of claim 6, further comprising a plurality of slits extending transversely across each of the scores, a recess at the intersection of each slit and the respective slit score, a crease line separating adjacent pairs of wall panel sections and horizontal panel sections, and a recess at the ends of each crease line.

8. The reinforced box-shaped structure of claim 7, further comprising a locking panel section adjacent each end flap, the locking panel section having side slots, the locking panel section extending under a respective top or bottom side with each of the side slots being received by respective two adjacent wall panel sections.

9. The reinforced box-shaped structure of claim 8, wherein the structure is made of corrugated paperboard.

10. The reinforced box-shaped structure of claim 9, wherein the end flaps include at least one handle apertures.

* * * * *